US008322908B1

(12) United States Patent
Hartmann

(10) Patent No.: US 8,322,908 B1
(45) Date of Patent: Dec. 4, 2012

(54) POOL FITTING WITH VENTURI

(76) Inventor: Warren Hartmann, Ventura, CA (US)

( * ) Notice: Subject to any disclaimer, the term of this patent is extended or adjusted under 35 U.S.C. 154(b) by 497 days.

(21) Appl. No.: 12/459,909

(22) Filed: Jul. 8, 2009

(51) Int. Cl.
*B01F 5/02* (2006.01)

(52) U.S. Cl. ..... 366/136; 366/163.2

(58) Field of Classification Search ..... 366/136, 366/137, 163.2
See application file for complete search history.

(56) References Cited

U.S. PATENT DOCUMENTS 3,166,020 A * 1/1965 Cook ..... 417/198
5,613,773 A * 3/1997 Scott et al. ..... 366/163.2
5,796,798 A * 8/1998 Aujollet et al. ..... 376/283

* cited by examiner

*Primary Examiner* — David Sorkin
(74) *Attorney, Agent, or Firm* — Louis F. Teran

(57) ABSTRACT

A wall mounted swimming pool venturi jet return line designed to increase water flow for better circulation without effecting the pool pump and filter system. Warm surface water is drawn through a venturi, driving warmer water down to the floor of the swimming pool. Water flow is substantially increased through the venturi jet thus improving water flow throughout the swimming pool. This helps prevent algae growth in poor circulating pools. The return line can rotate in a 360 degree angle, thereby providing multiple benefits and effects. A built-in flange with a locking nut holds the return line in the desired position.

6 Claims, 3 Drawing Sheets

POOL FITTING WITH VENTURI

BACKGROUND OF THE INVENTION

1. Field of the Invention

The field of this invention relates generally toward an outlet fitting for a swimming pool or similar body of water and particularly toward an outlet fitting that increases the pressure and flow of water returning to a swimming pool or similar body of water.

2. Description of the Prior Art

In large artificial bodies of water, usually designed for humans or other animals to swim in, water is typically returned from a filter to the larger body of water using an eyeball fitting that can be rotated across a wide range of angles to change the direction of entry of the return of water into the pool. The flow rate of the return water is dictated by the power of the pump. Furthermore, water is skimmed only from the top for filtration and returned only to the top using existing systems.

It is understood that heat rises as a general physical principle. Accordingly, in bodies of water, such as pools, the warmer water is near the surface of the pool. Furthermore, this warm water is primarily what is filtered and returned due to the limitations of the prior art eyeball fitting and return flow speed of water.

The inherent limitations of the circulation of water in prior art systems also results in dead spots in the pool where dirt and debris accumulate and/or are not swept toward the drains leading to the filter. Such dead spots can lead to the growth of algae and other unwanted life in the body of water.

The need for increased flow and circulation is becoming more imperative with the recent passage of legislation that requires the installation of new and replacement pool pumps. This legislation mandates that, regardless of size, pool pumps must be a 2-speed, multi-speed or ¾ hp or less pump. Millions of in-ground GUNITE®, fiberglass and vinyl pools are designed for larger pumps. Pool owners will now have to down-size to smaller pumps. This will have a negative effect on the flow of water in a pool. Lower flower rates aggravate the already poor circulation and create an increase in the likelihood of the development of algae blooms.

There is a need for a system for the return of filtered water to pools and other artificial bodies of water that overcome the deficiencies of the prior art.

SUMMARY OF THE INVENTION

The preferred embodiment of the present invention teaches a system and apparatus the provides a system wherein the flow of return water is increased and the warm water surrounding an inlet nozzle is mixed with the return by water by providing apertures along the length of the nozzle. This flange creates a venturi effect and is preferably present in a position in the nozzle where the water flows first through the flange before it reaches the apertures.

The return water passes through the flange, thereby increasing the velocity of the return stream. This provides for the system the ability to pull more pool water into the nozzle via the venturi effect.

Another optional feature of the nozzle is its ability to be mounted on a swivel in a rotatable, lockable fitting. This allows the user to aim the nozzle in multiple directions, each direction having its own distinct advantages, which are discussed below. When the nozzle barrel is rotated upward, the stream of water can be expelled out of the pool onto the deck, which wastes water and the thermal state of the water. This is avoided by setting the barrel of the nozzle at an angle of at least 30 degrees from the sidewall from the pool, usually no more than 80 degrees, with the optimal angle being determined to be 70 degrees.

These and many other features and attendant advantages of the invention will become apparent as the description of the invention and drawings proceeds.

The preferred embodiment teaches an improved return line fitting for artificial bodies of water comprising: a nozzle having a first open end in fluid communication with a return line of water returning from a pump, the return line having a first diameter and a second open end in fluid communication with the first open end allowing water to flow therethrough from the pump to the body of water; and a flange positioned between the first open end and the second open end that creates an area between the first open end and the second open end that has a second diameter wherein the second diameter is smaller than the first diameter.

The above embodiment can be further modified by defining that a plurality of apertures are proximate the second open end.

The above embodiment can be further modified by defining that the flange is secured in place with a locking nut.

The above embodiment can be further modified by defining that the nozzle is mounted on a swivel.

The above embodiment can be further modified by defining that the swivel is lockable.

The above embodiment can be further modified by defining that the swivel is rotatable 360 degrees.

The above embodiment can be further modified by defining that the nozzle is offset from the wall of said body of water at angle between 30 and 80 degrees.

The above embodiment can be further modified by defining that the nozzle is offset from said wall of said body of water at an angle of 70 degrees.

An alternate embodiment teaches a method for increasing the flow and circulation of water of existing artificial bodies of water comprising the steps of: locating pre-existing lock nut, eyeball fitting and male threaded fitting on the wall of the body of water; removing the lock nut and the eyeball fitting; threading onto the male threaded fitting an improved fitting, the fitting further comprising: a nozzle having a first open end in fluid communication with a return line of water returning from a pump, the return line having a first diameter and a second open end in fluid communication with the first open end allowing water to flow therethrough from the pump to the body of water; and a flange positioned between the first open end and the second open end that creates an area between the first open end and the second open end that has a second diameter wherein the second diameter is smaller than the first diameter; and replacing the lock nut.

The above embodiment can be further modified by defining that a plurality of apertures are proximate the second open end.

The above embodiment can be further modified by defining that the flange is secured in place with a locking nut.

The above embodiment can be further modified by defining that the nozzle is mounted on a swivel.

The above embodiment can be further modified by defining that the swivel is lockable.

The above embodiment can be further modified by defining that the swivel is rotatable 360 degrees.

The above embodiment can be further modified by defining that the nozzle is offset from the wall of the body of water at angle between 30 and 80 degrees.

The above embodiment can be further modified by defining that the nozzle is offset from said wall of said body of water at an angle of 70 degrees.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
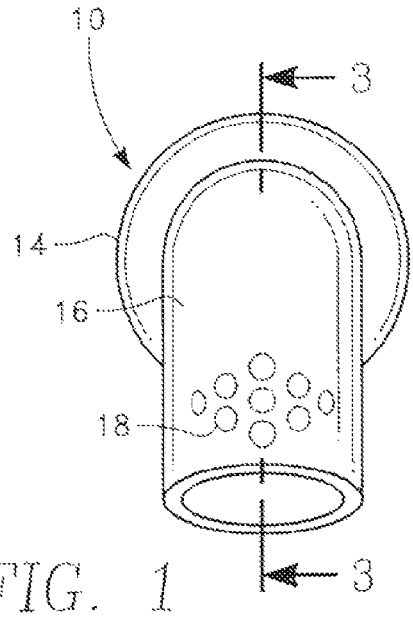
FIG. 1 shows a front view of the pool fitting of the present invention.

The instant invention discloses an improved venturi pool return line system. Existing return lines are usually composed of three components including a lock-nut, an eyeball fitting and a male 1½" threaded fitting, typically made of ABS plastic. The only step in replacing prior art return lines with the improved fitting of the instant invention is the removal of the lock-nut and the eyeball fitting and threading on a new venturi pool return line of the instant invention.

There are four primary positional modes for the return line of the instant invention. In the fountain mode, the return nozzle is aimed upward. In this mode, the water becomes very choppy, thereby creating a heavy water flowing sound. This will also help prevent sun from penetrating the surface and heating the water in hotter climates.

In the river mode, the return nozzle is aimed perpendicular to the fountain mode and aims water across the surface of the pool. In this mode, the water flow creates a soothing sound and helps to sweep leaves and debris toward the skimmer.

In the current mode, so called because it creates a current of moving water, the return nozzle is aimed toward the swimming pool wall, thereby creating a vortex that sweeps dirt and debris toward the main drain. This helps prevent algae growth and helps keep the pool clean.

In the energy efficient mode, the return nozzle is aimed toward the pool floor. This moves warm water toward the bottom of the pool and also forces the warm water created by gas or electric heaters, solar blankets, pool covers and solar panels to the floor of the pool, providing for a more consistent temperature throughout the pool.

Turning to the drawings, the preferred embodiment is illustrated and described by reference characters that denote similar elements throughout the several views of the instant invention.

Referring particularly to the drawings, there is shown in FIG. 1 a front view of the preferred embodiment of the swimming pool fitting 10 of the instant invention. The swimming pool fitting 10 attaches to a water return line 12 (see FIG. 2) through existing threaded male fittings and a lock nut 14. The water return line 12 is a pipe that protrudes out of the swimming pool wall or floor through which clean water from the filter of a swimming pool is pumped back into the swimming pool as indicated by arrow 22 in FIG. 2. When the swimming pool fitting 10 is attached to the water return line 12, the water is pumped into the swimming pool fitting 10 through the first open end 51, as indicated by arrow 20 in FIG. 3. Immediately after the water passes through the first open end 51, it is redirected by the curved section 55 of the swimming pool fitting 10. The curved section 55 is similar to a traditional elbow fitting and has a smoothly curved surface that redirects the water flow to a different angle relative to the water return line 12. After the water flow is redirected within the swimming pool fitting 10, the water exits through the second open end 52 at a different angle relative the water return line 12 and into the swimming pool, as indicated by arrows 26 in FIG. 3.

Figure 2:
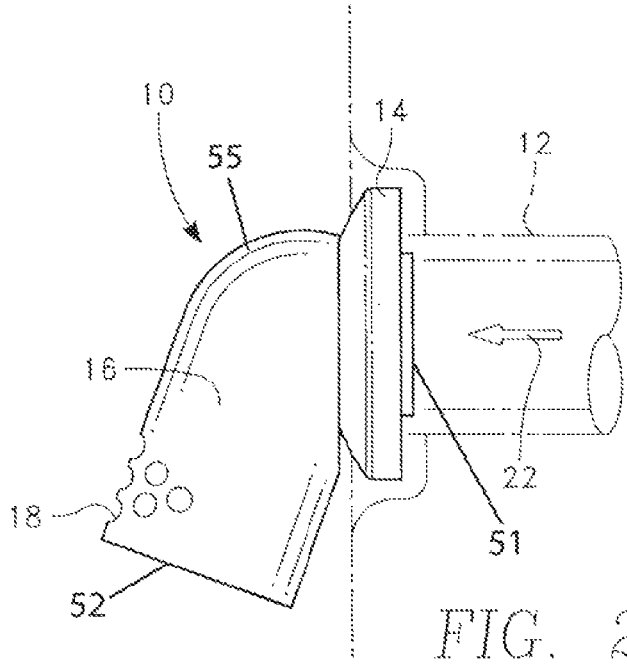
FIG. 2 shows a side view of the pool fitting of the present invention.
Figure 3:
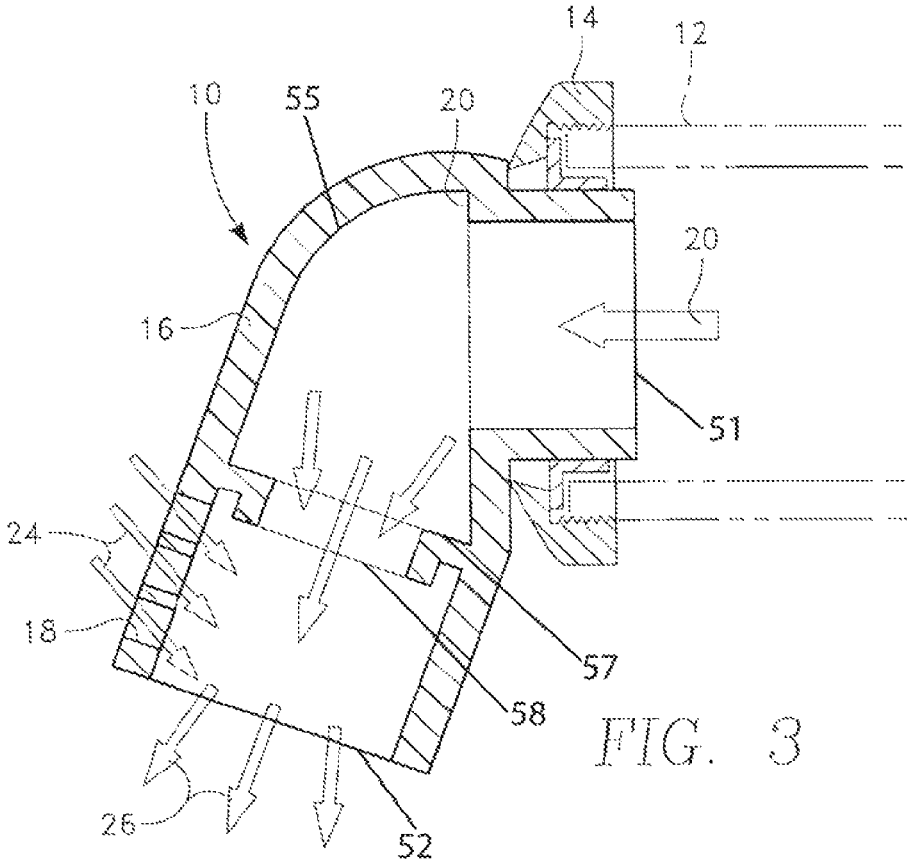
FIG. 3 is taken along line 3-3 in FIG. 1.

However, before exiting the swimming pool fitting 10, the water passes through a hole 58 that is formed by a thin flange 57. The swimming pool fitting 10 of the instant invention has the flange 57 located between the curved section 55 and the second open end 52. The diameter of the hole 58 must be smaller than the inside diameter of the first open end 51. The purpose of the flange 57 and the hole 58 is to induce a venturi effect. The flow of water collides against the thin flange 57. Said collision interrupts the flow of the water and facilitates the accumulation of water within the swimming pool fitting 10 that results in raising the pressure within the swimming pool fitting 10. The raised pressure within the swimming pool fitting 10 pushes the water through the hole 58 at a higher flow rate than a conventional return fitting. This venturi effect caused by the flange 57 and the hole 58 is known and has been used by various prior art, including in U.S. Pat. No. 3,166,020 ("the '020 Patent"). However, unlike the '020 Patent the swimming pool fitting 10 of the instant invention directs the water flow through the curved section 55 before reaching the flange 57. The curved section 55 obstructs the water flow and redirects it at a different angle. The obstructive nature of the curved section 55 agitates the water before it reaches the flange 57. The agitation of the water further promotes the pressure build-up at the flange 57 such that the water is induced to flow through the hole 58 at a higher velocity than it would under a traditional venturi nozzle without a curved section as in the '020 Patent. The primary stream of water flowing out of the hole 58 at a high velocity creates a low pressure condition that causes a "jet pump" effect which results in a secondary stream of water 24 being sucked in through the plurality of apertures 18. The resulting stream of water 26, which is the sum of the primary and secondary steams, flows out through the second open end 52. By combining the streams in the manner described, the flow rate of the water exiting from the swimming pool fitting 10 of the instant invention is increased without increasing the capacity of the pump employed to supply water to the swimming pool fitting 10. Such increased flow rates result in improved agitation of the water contained in the swimming pool or spa. FIG. 3 shows the swimming pool fitting 10 of the instant invention in action where the curved section and venturi effect are illustrated. In FIGS. 1-3, the energy efficient mode is illustrated wherein the returning water is directed toward the bottom of the pool.

Figure 4:
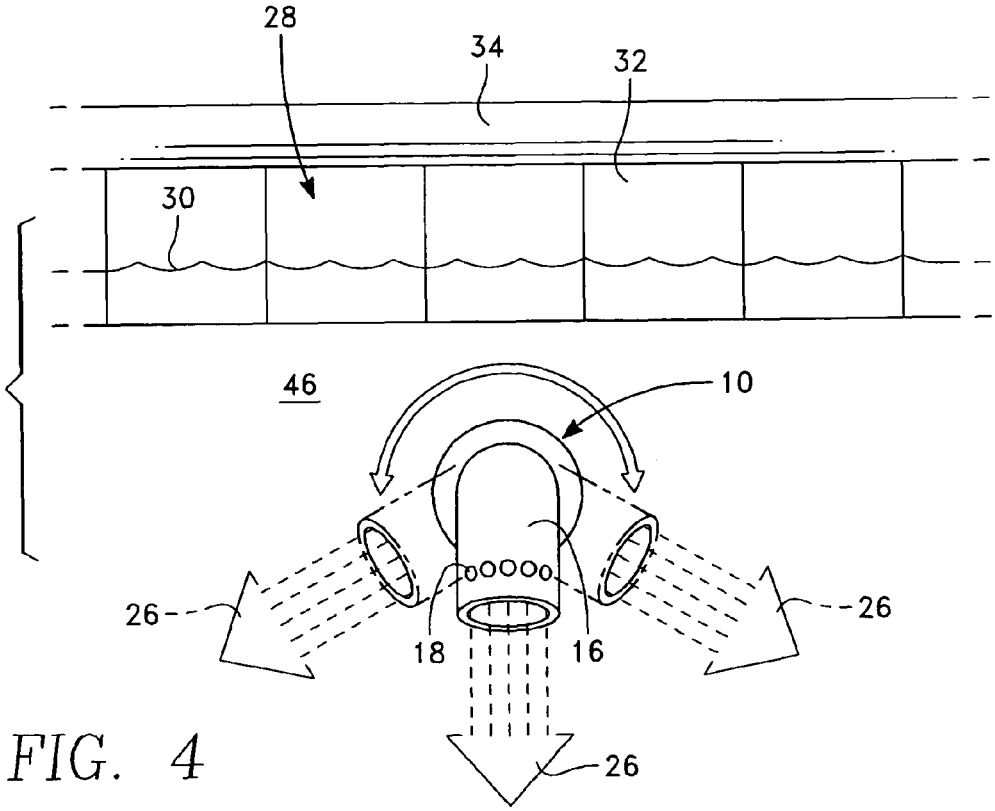
FIG. 4 shows the rotational features of the pool fitting of the present invention and an optional aperture pattern in the nozzle of the fitting.

In FIG. 4 it is shown how the nozzle 16 can rotate 360 degrees for the desired direction of the return water 26. As is clear to see in FIGS. 4-7, the return line is positioned in the standard position in the pool 28 which is on the wall 46 of the pool below the coping 34, the tile 32 and the water line 30.

Figure 5:
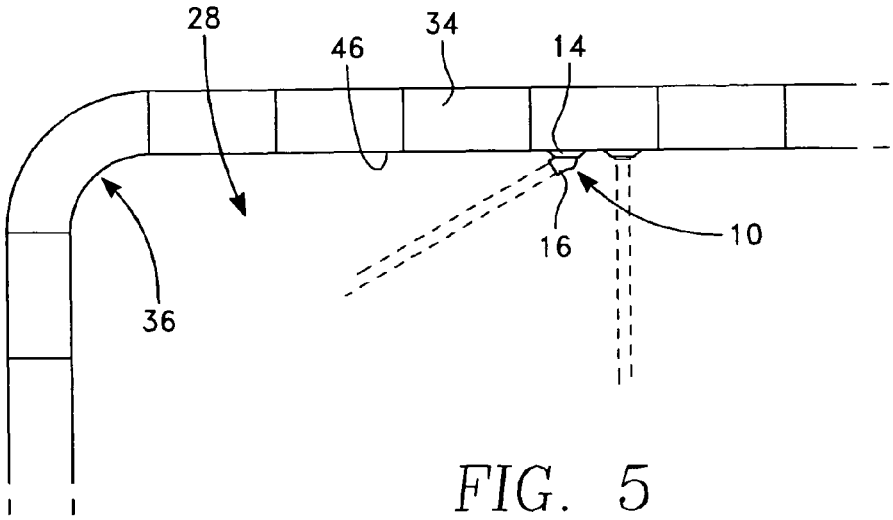
FIG. 5 is a plan view of the corner of a swimming pool showing the pool fitting of the instant invention alongside a prior art pool fitting.

In FIG. 5, the device 10 of the instant invention is compared side by side with a prior art device 40 in the corner 36 of the pool 28. The return water 26 can head in any direction, dictated by the position of the device 10 while the prior art invention is limited due its structure in the direction it flows. Not illustrated, but a fact to state is that the return water is returning at a much higher rate in the instant invention due to the venturi created by the flange 20.

Figure 6:
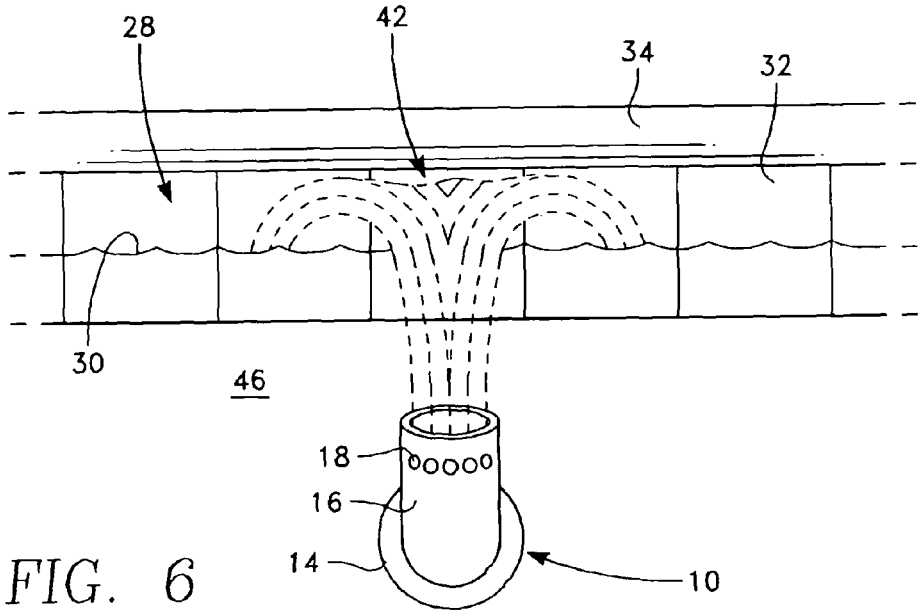
FIG. 6 shows the upward fountain effect produced by one position of the pool fitting of the present invention.

Illustrated in FIG. 6 is the fountain effect created when the return flow 42 of water through the device 10 is directed upward. As stated earlier, for optimal results, the angle of the barrel of the nozzle 26 is offset between 30 and 80 degrees from the wall 46 of the pool 28, optimally being offset 70 degrees. This creates a fountain effect while preventing the loss of water over the top of the pool 28 and onto the deck.

Figure 7:
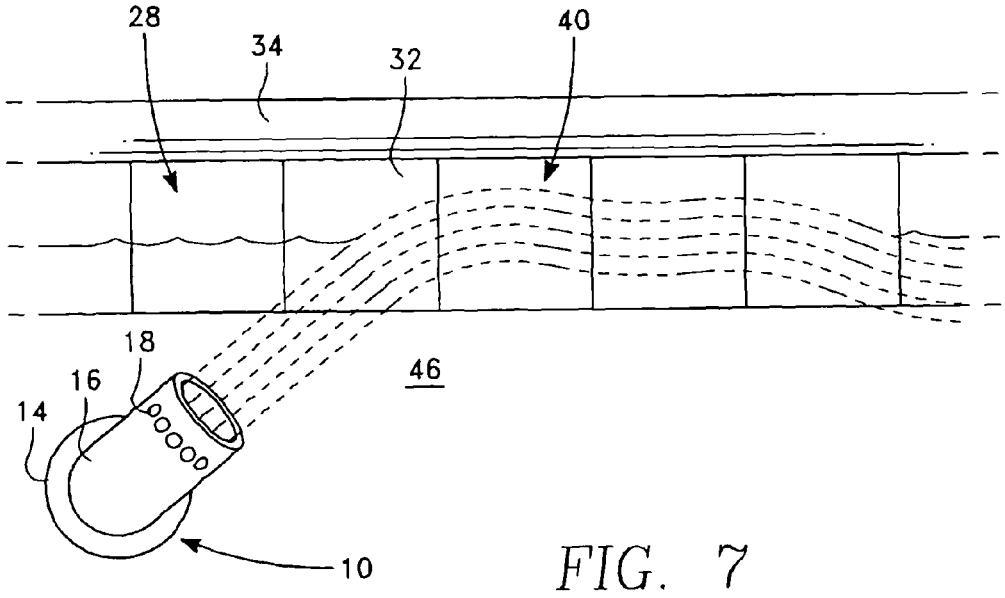
FIG. 7 shows the sideways current effect produced by one position of the pool fitting of the present invention.

FIG. 7 shows the current effect when the nozzle 26 is directed substantially sideways. The return flow 40 of water through the device 10 creates an agitated surface and the pleasant aesthetic effect of moving water.

The discussion included in this patent is intended to serve as a basic description. The reader should be aware that the specific discussion may not explicitly describe all embodiments possible and alternatives that are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A swimming pool fitting comprising:

a lock nut that attaches said swimming pool fitting to a water return line of a swimming pool;

a first open end having an inner diameter and being in fluid communication with said water return line and through which a flow of water enters said swimming pool fitting;

a curved section adjacent said first open end that redirects said flow of water to an angle relative to said water return line;

a second open end that is in fluid communication with said first open end and that directs said flow of water to exit said swimming pool fitting at said angle;

a thin flange forming a hole that is smaller than said inner diameter through which said flow of water passes and that is located between said curved section and said second open end; and a plurality of apertures between said thin flange and said second open end.

2. The swimming pool fitting of claim 1 wherein said lock nut rotatably attaches said swimming pool fitting to said water return line.

3. The swimming pool fitting of claim 2 wherein said lock nut can lock said swimming pool fitting in one of four positional modes that include fountain mode, river mode, current mode, and energy efficient mode.

4. The swimming pool fitting of claim 1 that is mounted on a swivel.

5. The swimming pool fitting of claim 4 wherein said swivel is lockable.

6. The swimming pool fitting of claim 4 wherein said swivel is rotatable 360 degrees.

* * * * *